United States Patent [19]

Fleury et al.

[11] Patent Number: 4,471,266

[45] Date of Patent: Sep. 11, 1984

[54] DELAY LINE FOR A TRAVELING-WAVE TUBE COOLED BY HEAT PIPES AND A TRAVELING-WAVE TUBE COMPRISING A DELAY LINE OF THIS TYPE

[75] Inventors: M. Georges Fleury; Arvind Shroff, both of Paris, France

[73] Assignee: Thomson-CSF, Paris, France

[21] Appl. No.: 316,683

[22] Filed: Oct. 30, 1981

[30] Foreign Application Priority Data

Nov. 7, 1980 [FR] France ..... 80 23883

[51] Int. Cl.[3] ..... H01J 25/34

[52] U.S. Cl. ..... 315/3.5; 313/17; 313/46

[58] Field of Search ..... 313/17, 18, 19, 20, 313/24, 39, 46; 315/3.5

[56] References Cited

U.S. PATENT DOCUMENTS

| | | | |
|---|---|---|---|
| 3,317,780 | 5/1967 | Ayers | 313/17 X |
| 3,398,315 | 8/1968 | Washburn | 313/46 |
| 3,538,366 | 11/1970 | Glien et al. | 313/46 X |
| 3,876,901 | 4/1975 | James | 313/17 X |
| 4,243,914 | 1/1981 | Delory et al. | 313/17 |
| 4,274,032 | 6/1981 | Dodonov et al. | 313/17 |

FOREIGN PATENT DOCUMENTS

| | | | |
|---|---|---|---|
| 2425145 | 3/1978 | France | 315/3.5 |

*Primary Examiner*—Saxfield Chatmon
*Attorney, Agent, or Firm*—Roland Plottel

[57] ABSTRACT

A coupled-cavity delay line for traveling-wave tubes is provided with a cooling system which permits heat distribution along the entire length of the delay line and ensures that the outer surface of the vacuum enclosure is isothermal. The cooling system consists of a cylindrical sleeve containing heat pipes. The cylindrical sleeve is located between the external wall of the resonant cavities and the permanent magnets. The heat pipes are disposed at uniform angular intervals within the double-walled sleeve and extend lengthwise along the delay line.

2 Claims, 2 Drawing Figures

CROSS-SECTION AA'

CROSS-SECTION BB'

Figure 1:
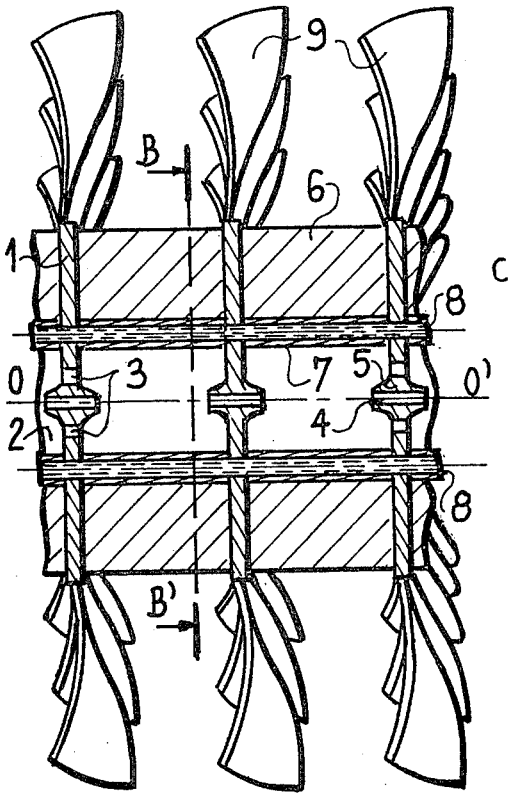

DELAY LINE FOR A TRAVELING-WAVE TUBE COOLED BY HEAT PIPES AND A TRAVELING-WAVE TUBE COMPRISING A DELAY LINE OF THIS TYPE

This invention relates generally to the field of traveling-wave tubes and is more particularly concerned with a delay line, especially of the type having coupled cavities and employed in a traveling-wave tube, cooling of the delay line being performed by means of heat-transfer devices known as heat pipes.

Coupled-cavity delay lines are used in traveling-wave tubes in which they ensure interaction between an electron beam which passes along the axis of the line, and an electromagnetic wave which travels along the line. When conditions of synchronism of the wave and of the beam are achieved, the electrons impart energy to the electromagnetic wave.

Coupled-cavity delay lines are constituted by a series of resonant cavities separated from each other by walls each pierced with at least one coupling aperture between cavities and with one opening for traversal of the electron beam which is focused along the axis of the line. The focusing device can consist of an electromagnet but is more usually constituted by an alternate series of permanent magnet rings along the axis of the line.

It is a known practice to cool the delay line by forced air when the mean HF power does not exceed one kilowatt at 10 GHz, for example. Unfortunately, forced-air cooling of the HF structure presents problems for the following reason: the densities of power removed by air cooling are of low value, especially if a small temperature difference is intended to remain between the cold source and the fluid. There is therefore no longer any question of circulating air between the vacuum enclosure and the magnets, with the result that steps must be taken to arrange cooling fins externally of the focusing system. The temperature difference between the heat source (cavity noses) and the cold source (fins) is substantially increased with all the attendant risks of defocusing which this involves.

This temperature difference may be substantially reduced if arrangements are made to ensure that the heat flux dissipated at the end of the HF structure does not pass through the last two or three magnets but through the entire focusing system. It is necessary in this case to reduce the axial thermal impedance in order to ensure that the temperature of the delay circuit is made as uniform as possible.

The axial thermal impedance can be reduced by increasing the thickness of the cylindrical wall of the delay line. However, since this wall is made alternately of copper and of soft iron which has fairly low thermal conductivity, the thickness must be considerably increased. This results in magnets which are much larger and therefore much more costly, the tube being consequently heavier and more cumbersome. Furthermore, the interface thermal resistance produced by the brazed joint between these materials also plays a contributory role in increasing the axial thermal impedance.

When traveling-wave tubes attain a high value of mean power, forced-air cooling is no longer possible. Cooling by fluid flow is then adopted for the delay line since substantial high-frequency losses take place within this latter. Furthermore, the dispersion which is inherent in the electron beam causes additional heat build-up. The cylindrical walls which limit the cavities externally are accordingly traversed by ducts through which the coolant fluid is circulated. In consequence, the thickness of said walls must be increased and this leads to the same problems of overall size as those which have already been mentioned.

Furthermore, local overheating of a single cavity may arise as a result of an accidental operating condition of the traveling-wave tube. Such overheating may have serious consequences and even cause destruction of the tube as a result of melting of the cavity nose concerned. Known types of air-cooling systems employed in the prior art fail to provide against an accidental operating condition of this kind.

This invention proposes to solve the general problem by means of a cooling system which permits heat distribution over the entire length of the delay line and also serves to ensure that the outer surface of the vacuum enclosure is made isothermal. A system of this type provides for the use of heat pipes which extend lengthwise along the delay line.

In more precise terms, the invention relates to a delay line for a traveling-wave tube and especially a tube having coupled cavities, whose design function is to produce interaction between an electron beam and an electromagnetic wave which propagates along the delay line, said line being limited externally by a device for focusing the electron beam along the axis of the line. Said focusing device is constituted by an alternate series of permanent magnets and pole pieces which limit the cavities on each side, said pole pieces being constituted by circular walls. Each wall is common to two cavities and pierced by at least one intercavity coupling aperture as well as a central aperture for the passage of the electron beam. The delay line is distinguished by the fact that it is also provided with a cylindrical sleeve surrounded by the focusing device. The sleeve is traversed by heat pipes disposed at uniform intervals around the periphery of said sleeve and extending along the delay line in the direction of propagation of the electron beam.

Figure 2:
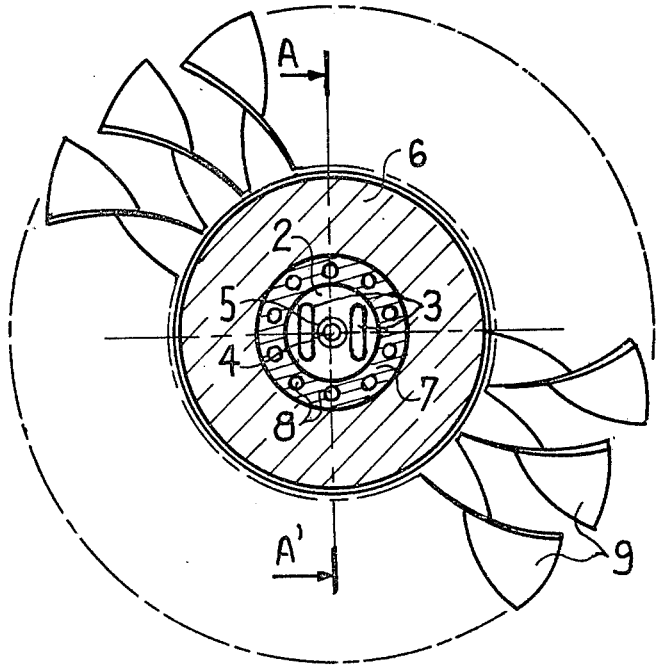

Other features of the invention will be more apparent upon consideration of the following description and accompanying drawings, wherein FIGS. 1 and 2 are longitudinal and transverse sectional views respectively of a portion of delay line in accordance with the invention.

The delay line shown by way of example in the figures is of the type comprising coupled cavities and a series of disks 1 of magnetic material or pole pieces aligned in parallel relation to each other along a common axis O—O′ which coincides with the axis of propagation of the electron beam. Said disks form the wall which is common to two adjacent cavities 2. Each disk is pierced by two apertures 3 which provide a coupling between cavities, said apertures being symmetrical with respect to the axis of the line O—O′. In addition, each disk is also pierced by an aperture 4 through which the electron beam is intended to pass. Said aperture 4 is located at the center of the disk, is usually of circular shape and surrounded by a coaxial annular flange designated as a cavity nose 5. The electron-beam focusing device surrounds the cavities and is constituted by an alternate arrangement of permanent magnets 6 and pole pieces 1.

The delay line according to the invention is distinguished by the fact that it comprises in addition a cylindrical sleeve 7 of copper, for example, and located between the outer wall of the cavities and the focusing device.

Within said sleeve are placed a predetermined number of heat pipes 8 spaced at uniform intervals around the periphery of the sleeve and extending along the delay line in the direction of propagation of the electron beam. The design function of said heat pipes is to distribute heat along the full length of the delay line and to ensure that the external surface of the vacuum enclosure is made isothermal. The heat flux can then pass through the focusing system with a lower surface density and therefore a lower gradient, either through the pole pieces or through copper bars which can be placed between the pole pieces and occupy a volume corresponding to a fraction of magnet.

In both cases, the heat flux is directed either towards a radiator or towards cooling fins 9 in order to maintain a large heat-transfer surface area.

This cooling device makes use of heat pipes 8 essentially consisting of a vacuum-tight column of hollow construction and closed at both ends, the inner wall of said column being lined with several layers of fine-mesh wire netting which constitutes a capillary system.

A material which is volatile at the operating temperature and has good heat conductivity is introduced within the interior of the heat pipe in sufficient quantity to saturate the capillary system with a slight excess.

The latent heat of vaporization of the heat-transfer fluid is turned to profitable use since the vapor passes from the evaporator (HF output side) to the condenser (the whole tube) in which it is recovered in the form of condensation heat; the condensed vapor flows back to the evaporator under the action of forces of gravity or capillary forces. It is worthy of note that the system is also capable of operating in the direction of gravity, in the direction opposite to gravity or else horizontally or in acceleration.

When operating in the direction of gravity (evaporator in the bottom position, condenser in the top position), the capillary system serves essentially to return the condensed fluid to the evaporator, thus avoiding the formation of fluid plugs which retard the circulation of vapor.

When operating in the direction opposite to gravity (evaporator in the top position, condenser in the bottom position) or horizontally, the function of the capillary system becomes important since this latter returns the fluid to the evaporator. The ratio of flux transferred during operation in the direction of gravity and in the opposite direction is 10:1.

The properties required for the heat-transporting fluid are as follows:

melting temperature: low
vaporization temperature: in the vicinity of or below the operating temperature
surface tension: high
low viscosity
latent heat of vaporization: high.

The most suitable fluids are water as well as certain organic substances such as the substance known by the trade name Dowtherm.

At the time of start-up, operation of the system is not initiated, the temperature at the level of the evaporator rises, the heat-transporting fluid evaporates and the heat is transferred to the cold zone or in other words the vapor condenses therein and the fluid returns to the evaporator via the capillary system.

The delay line can comprise n integrated heat pipes. In this case, the maximum flux transported by the heat pipe will be:

$$\frac{Q}{n} = \frac{m_{max}}{n} \cdot L$$

L: latent heat of vaporization of the fluid.
$m_{max}$: maximum mass rate of flow transported within the capillary system.

The general equation of heat pipes is:

$$m = \frac{\rho_1 K A_\omega}{\mu_1 l_{eff}} \left( \frac{2\sigma}{r_c} \cos\theta - \rho_1 g\, l_{eff} \sin\phi \right)$$

$\rho_1$, $\mu_1$: density and viscosity of the liquid.
$r_c$: radius of the capillary wire.
$\theta$: wetting angle.
$\phi$: inclination of the heat pipe with respect to the horizontal.
K: constant.
$l_{eff}$: effective length of transfer of vapor.
$\sigma$: surface tension of the liquid.
$A_\omega$: useful surface area of the capillary core.

When the heat flux Q to be transferred and the latent heat of vaporization of the fluid L are known, the mass rate of flow m transported within the capillary system is calculated and the radius rc of the capillary wire is deduced therefrom. The dimensions of the heat pipe are determined from these elements.

The use of heat pipes for cooling delay lines can be applied generally to types of lines other than those comprising coupled cavities and given solely by way of example in the foregoing description. Thus the use of such heat pipes may be contemplated for helical lines or shunt-circuit lines.

What is claimed is:

1. A delay line for a traveling-wave tube, especially a tube having coupled cavities, whose design function is to produce interaction between an electron beam and an electromagnetic wave which propagates along the delay line, said line being limited externally by a device for focusing the electron beam along the axis of the line, said focusing device being constituted by an alternate series of permanent magnets and pole pieces which limit the cavities on each side, said pole pieces being constituted by circular walls, each wall being common to two cavities and pierced by at least one intercavity coupling aperture as well as a central aperture for the passage of the electron beam, wherein said delay line is also provided with a cylindrical sleeve surrounded by the focusing device, said sleeve being traversed by vacuum tight columns, of hollow construction, and closed at both ends, the inner wall of each column constituting a capillary system, and a material which is volatile at the operating temperature saturating said capillary system with a slight excess disposed at uniform intervals around the periphery of said sleeve and adapted to extend along the delay line in the direction of propagation of the electron beam.

2. A traveling-wave tube comprising means for producing an electron beam and for propagating said beam towards a beam collector, and a delay line placed along the path of the beam, the electromagnetic waves which interact with the beam during operation being propagated along a delay line of the type defined in claim 1.

* * * * *